US011292692B2

(12) United States Patent
Zhou

(10) Patent No.: US 11,292,692 B2
(45) Date of Patent: Apr. 5, 2022

(54) SPEED LIMITING SYSTEM, RELEASING DEVICE, SPEED LIMITING SYSTEM FOR ELEVATOR AND ELEVATOR

(71) Applicant: Otis Elevator Company, Farmington, CT (US)

(72) Inventor: Yaxu Zhou, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 419 days.

(21) Appl. No.: 16/358,087

(22) Filed: Mar. 19, 2019

(65) Prior Publication Data

US 2019/0284023 A1 Sep. 19, 2019

(30) Foreign Application Priority Data

Mar. 19, 2018 (CN) ..... 201810223801.2

(51) Int. Cl.
*B66B 5/02* (2006.01)
*B66B 5/04* (2006.01)

(52) U.S. Cl.
CPC ..... *B66B 5/02* (2013.01); *B66B 5/044* (2013.01)

(58) Field of Classification Search
CPC ..... B66B 5/02; B66B 5/044
See application file for complete search history.

(56) References Cited

U.S. PATENT DOCUMENTS 5,566,784 A 10/1996 Rennetaud
6,345,698 B1 2/2002 Ravishankar
7,562,749 B2 7/2009 Race, Sr. et al.
9,382,098 B2 7/2016 Arai et al.
9,517,920 B2 12/2016 Mertala et al.
(Continued)

FOREIGN PATENT DOCUMENTS

CN 1182040 A 5/1998
CN 1894152 A 1/2007
(Continued)

OTHER PUBLICATIONS

Alibaba, "Construction Roller Guiding Roller Zenit Hoist", availabe at: https://www.alibaba.com/product-detail/construction-roller-guiding-roller-ZENIT-hoist_294563086.html, accessed Mar. 19, 2019, 8 pages.

(Continued)

*Primary Examiner* — Diem M Tran
(74) *Attorney, Agent, or Firm* — Cantor Colburn LLP

(57) ABSTRACT

A speed governing system, a releaser, an elevator speed governing system, and an elevator. The speed governing system comprises a speed governor for detecting an overspeed condition of a motion device, and a releaser connected to the speed governor. The releaser comprises: a housing; at least one positioning pin having a section that is disposed in the housing and at least partially constructed to have an arc-shaped outline; and a releasing component passing through the housing and provided with a groove on its portion located in the housing, wherein the groove is constructed to be adaptable to the arc-shaped outline, for accommodating the section to fix the releasing component relative to the housing, and be separated from the section when the speed governor detects the overspeed condition and moves the releasing component relative to the housing.

16 Claims, 2 Drawing Sheets

(56) References Cited

U.S. PATENT DOCUMENTS

| | | | |
|---|---|---|---|
| 9,630,805 | B2 | 4/2017 | Fargo et al. |
| 9,725,281 | B2 | 8/2017 | Fargo et al. |
| 9,731,937 | B2 | 8/2017 | Steiner et al. |
| 2003/0102613 | A1 | 6/2003 | Alves |

FOREIGN PATENT DOCUMENTS

| | | | | |
|---|---|---|---|---|
| CN | 2855166 | Y | 1/2007 | |
| CN | 201016077 | Y | 2/2008 | |
| CN | 201068358 | Y | 6/2008 | |
| CN | 202707723 | U | 1/2013 | |
| CN | 204251140 | U | 4/2015 | |
| CN | 106956989 | A | 7/2017 | |
| DE | 102015103076 | A1 | 9/2016 | |
| EP | 1770044 | A1 * | 4/2007 | ..... B66B 5/044 |
| EP | 1806310 | A1 | 7/2007 | |
| FR | 1260265 | A | 5/1961 | |
| JP | 2005280902 | A | 10/2005 | |
| JP | 2019196241 | A | 11/2019 | |
| WO | 2006081594 | A1 | 8/2006 | |

OTHER PUBLICATIONS

L.A. Ornamental, "Adjustable Bracket Guide Roller with Sliding Rolling Gate 3 ½" Max Capacity", avaiable at: https://www.amazon.com/Adjustable-Bracket-Guide-Roller-Capacity/dp/B01MR52HRW, accessed: Mar. 19, 2019, 7 pages.

* cited by examiner

SPEED LIMITING SYSTEM, RELEASING DEVICE, SPEED LIMITING SYSTEM FOR ELEVATOR AND ELEVATOR

FOREIGN PRIORITY

This application claims priority to Chinese Patent Application No. 201810223801.2, filed Mar. 19, 2018, and all the benefits accruing therefrom under 35 U.S.C. § 119, the contents of which in its entirety are herein incorporated by reference.

TECHNICAL FIELD

The present invention relates to the field of electromechanical equipment, and in particular, to a speed governing system, a releaser, an elevator speed governing system, and an elevator.

BACKGROUND ART

For the sake of safety and other aspects, it is generally needed to provide some motion mechanisms, devices or equipment such as elevators with, for example, a speed governor, a releaser, and the like to monitor their operating conditions, such that corresponding safety measures are taken in time when they are overspeed, and thus equipment and personal safety can be protected as expected. A variety of devices such as releasers and speed governors have been provided in the prior art; however, there are still disadvantages and defects in their performance aspects such as structure construction, use effect, and safety.

SUMMARY OF THE INVENTION

In view of this, a speed governing system, a releaser, an elevator speed governing system, and an elevator are provided in the present invention, for solving or at least alleviating the foregoing problems and one or more problems in other aspects in the prior art.

First, according to a first aspect of the present invention, a speed governing system is provided, which comprises a speed governor for detecting an overspeed condition of a motion device, and a releaser connected to the speed governor, wherein the releaser comprises: a housing; at least one positioning pin having a section that is disposed in the housing and at least partially constructed to have an arc-shaped outline; and a releasing component passing through the housing and provided with a groove on its portion located in the housing, wherein the groove is constructed to be adaptable to the arc-shaped outline, for accommodating the section to fix the releasing component relative to the housing, and be separated from the section when the speed governor detects the overspeed condition and moves the releasing component relative to the housing.

In the speed governing system according to the present invention, optionally, the at least one positioning pin includes two positioning pins disposed respectively at two sides of the portion of the releasing component, and the releasing component is provided with a first groove and a second groove for accommodating the section of one positioning pin and the section of the other positioning pin, respectively.

In the speed governing system according to the present invention, optionally, at least one of the two positioning pins has an extending section passing through the outer wall of the housing.

In the speed governing system according to the present invention, optionally, the outer wall of the housing is provided with a recess or a protrusion that is adapted to fix an end of the extending section thereon.

In the speed governing system according to the present invention, optionally, the at least one positioning pin is a first positioning pin, the releaser further includes a second positioning pin having a section disposed in the housing and constructed to have a sharp-angled outline, and the releasing component is provided with a first groove and a second groove for accommodating the section of the first positioning pin and the section of the second positioning pin, respectively.

In the speed governing system according to the present invention, optionally, the first positioning pin has an extending section passing through the outer wall of the housing.

In the speed governing system according to the present invention, optionally, the outer wall of the housing is partially constructed to be adapted to fix an end of the extending section thereon.

In the speed governing system according to the present invention, optionally, the disposing direction of the section of the at least one positioning pin is perpendicular to that of the releasing component.

In the speed governing system according to the present invention, optionally, the housing has a hollow cavity, the releaser further includes an elastic component located in the hollow cavity, and the elastic component is configured to provide an elastic force to cause the section of the at least one positioning pin to be accommodated in the groove to fix the releasing component relative to the housing, and be compressed when the releasing component is moved relative to the housing to cause the groove to be separated from the section of the at least one positioning pin.

In the speed governing system according to the present invention, optionally, the releaser further includes a pedestal located in the hollow cavity, the pedestal is disposed between the releasing component and the elastic component and abuts against the elastic component, and one of the at least one positioning pin is disposed on the pedestal.

In the speed governing system according to the present invention, optionally, the releaser further includes an elastic force adjusting component configured to adjust the elastic force of the elastic component.

In the speed governing system according to the present invention, optionally, the releasing component is provided with an observing place configured for observing a relative moving position between the releasing component and the housing from the exterior of the housing.

In the speed governing system according to the present invention, optionally, the housing is manufactured by machining.

In the speed governing system according to the present invention, optionally, the housing is provided with an end cap to be fixedly mounted to the body of the housing.

In the speed governing system according to the present invention, optionally, the elastic component is a spiral spring, and/or at least one of the at least one positioning pin is a cylindrical pin.

In the speed governing system according to the present invention, optionally, the speed governing system further includes a linkage mechanism through which the releaser is connected to the speed governor.

Next, according to a second aspect of the present invention, a releaser is provided, wherein the releaser is the releaser in the speed governing system according to any of the foregoing items.

Moreover, according to a third aspect of the present invention, an elevator speed governing system is further provided, wherein the elevator speed governing system is provided with the speed governing system according to any of foregoing items.

Moreover, according to a fourth aspect of the present invention, an elevator is further provided, wherein the elevator is provided with the elevator speed governing system as described in the foregoing.

In the elevator according to the present invention, optionally, the elevator speed governing system is disposed at a car side or a counterweight side of the elevator.

Characteristics, features, advantages, and the like of various technical solutions according to the present invention will become obvious through the following detailed description with reference to accompanying drawings, and design ideas and principles of the present invention are illustrated through examples. However, it should be appreciated that the description is merely provided for exemplification, and thus should not be construed as limiting the scope of the present invention.

BRIEF DESCRIPTION OF THE DRAWINGS

The technical solutions of the present invention will be described below in detail with reference to the accompanying drawings and embodiments. However, it should be noted that these accompanying drawings are designed merely for explanation and merely intended to conceptually illustrate structure constructions described here, and thus is not necessarily drawn proportionally.

DETAILED DESCRIPTION

First, it should be noted that structures, compositions, principles, characteristics, advantages, and the like of a speed governing system, a releaser, an elevator speed governing system, and an elevator according to the present invention will be illustrated below through examples; however, all description should not be used to limit the present invention.

Moreover, for any single technical feature described or implied in the embodiments involved in this text or any single technical feature shown or implied in each accompanying drawing, the present invention still allows these technical features (or equivalents thereof) to be randomly combined or deleted, thus obtaining other more embodiments of the present invention that may not be mentioned in this text directly. In addition, to simplify the drawings, identical or similar parts and features may be marked at only one or several places in the same accompanying drawing.

Figure 1:
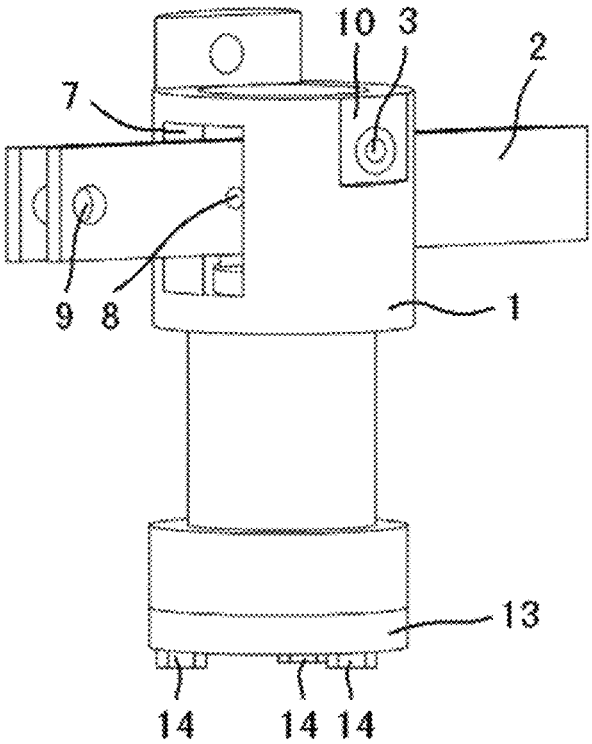
FIG. 1 is a schematic three-dimensional structural diagram of an embodiment of a releaser according to the present invention.
Figure 2:
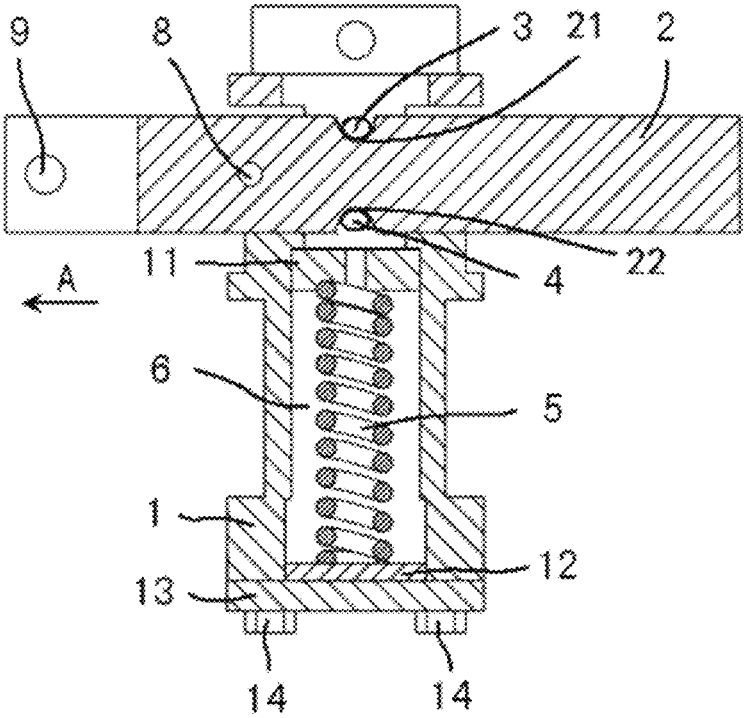
FIG. 2 is a schematic sectional structural diagram of the embodiment of the releaser shown in FIG. 1.

To facilitate understanding the present invention, the releaser according to the present invention will be introduced below first. FIG. 1 is a schematic three-dimensional structural diagram of an embodiment of a releaser according to the present invention, and FIG. 2 is a schematic sectional structural diagram of this embodiment. The structure of the embodiment of the releaser is exemplified substantially through these accompanying drawings, and basic structural compositions and the like of the releaser will be illustrated below in detail.

Please refer to FIG. 1 and FIG. 2 together. The embodiment of the releaser is provided to work cooperatively with a speed governing system, for safety protection when a motion device such as an elevator is overspeed. Specifically, the speed governing system is provided with a speed governor, which may be any currently-known or future-improved speed governor, and such a speed governor can detect the overspeed condition of the motion device. When detecting that the motion device is overspeed, the speed governor will manipulate the releaser together with other possibly provided components, devices or mechanisms (for example, for an elevator, the releaser can be manipulated together with a linkage mechanism, a safety gear pull rod, a safety gear wedge, and the like) to prevent further motion of the motion device or reduce the current moving speed of the motion device, thus achieving the effects of safety protection and avoiding equipment damages or personal injuries.

In this provided embodiment, the releaser includes a housing 1, a releasing component 2, a positioning pin 3, a positioning pin 4, an elastic component 5, a pedestal 11, and a gasket 12. Compared with a housing of an existing releaser, the housing 1 has a quite simplified structure, and especially it can be manufactured very conveniently and quickly by machining. As shown in FIG. 2, the housing 1 can be optionally provided with an end cap 13, which is then fixedly mounted to the body of the housing 1 by means of one or more connectors 14 (such as bolts and screws), or by thread connection, snap fit, or another suitable connecting manner (or a combination thereof), thus forming the entirety of the housing 1. For example, it is exemplified in FIG. 1 that the end cap 13 is mounted to the body of the housing 1 by three bolts. In the foregoing manner, some parts can be assembled into the housing conveniently from one side of the end cap of the housing 1, or some parts can be maintained or replaced conveniently when required. Moreover, as shown in FIG. 2, a hollow cavity 6 can be provided in the housing 1, such that such parts as the elastic component 5, the pedestal 11, and the gasket 12 can be disposed in the hollow cavity 6, which will be illustrated in detail subsequently.

Figure 3:
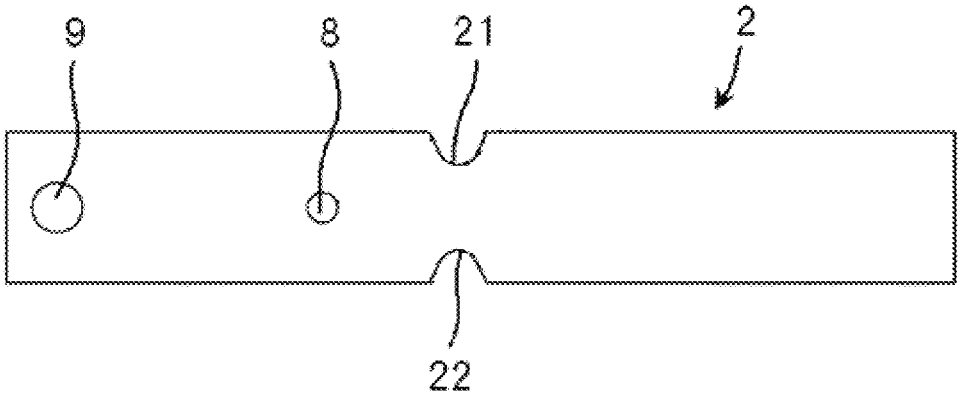
FIG. 3 is a schematic front structural diagram of a releasing component in the embodiment of the releaser shown in FIG. 1.

The positioning pin 3 and the positioning pin 4 are positioning components for fitting with the releasing component 2, and each has a section disposed in the housing 1. In the present invention, all or a part of the section is creatively constructed to have an arc-shaped outline. For example, FIG. 3 only schematically shows that an outline 30 of a section 31 on the positioning pin 3 is wholly constructed to be arc-shaped. As an example, it is advocated in the present invention that a universal component such as a cylindrical pin can be directly used as the positioning pin in the releaser, and this will be advantageous in reducing the comprehensive costs in terms of manufacturing, use, maintenance, and the like. However, it should be appreciated that it is completely allowed to use a positioning pin having an irregular or complex outline in the present invention according to actual application requirements. For example, several sections on the positioning pin that are separated from each other can be constructed to have the same arc-shaped outline, while some structures recessed towards a central axis of the positioning pin are disposed between the sections, and such recessed structures will not affect matching contact between the positioning pin and a groove structure on the releasing component 2 that will be described below in detail.

Figure 4:
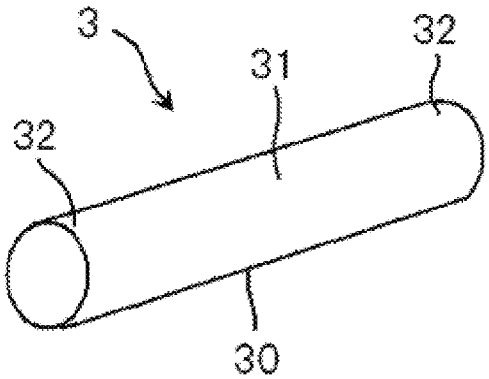
FIG. 4 is a schematic three-dimensional structural diagram of a positioning pin in the embodiment of the releaser shown in FIG. 1.

As an example, as shown in FIG. 4, the positioning pin 3 in the releaser can optionally have an extending section 32 passing through the outer wall of the housing 1. That is, a hole can be opened in the housing 1, and the positioning pin 3 is mounted to the releaser very conveniently and quickly from the exterior of the housing 1. This is quite convenient for mounting, replacement, and other operations for the positioning pin 3. Moreover, a part of the outer wall 10 of the housing 1 can optionally be constructed into, for example, a recess, a protrusion, or any other suitable shape, such that an end of the extending section 32 of the positioning pin 3 can be better accommodated to be firmly fixed to the part of the outer wall 10, thus helping further improve the stability and reliability of motions of a lifting mechanism. The part of the outer wall 10 of the housing 1 can be formed by casting or manufactured directly by machining very conveniently. For example, FIG. 1 shows a plane-shaped recess made by machining, and such a recess helps fix the positioning pin 3 on the housing 1 constantly, steadily, and reliably.

In the provided embodiment of the releaser, the other positioning pin 4 is disposed on the pedestal 11 located in the hollow cavity 6. The pedestal 11 is disposed between the releasing component 2 and the elastic component 5 and abuts against the elastic component 5 (for example, using a spiral spring) also disposed in the hollow cavity 6. Therefore, under the effect of the elastic force provided by the elastic component 5, the positioning pin 4 on the pedestal 11 will be pushed and accommodated in a groove 22 of the releasing component 2, such that a relative position between the releasing component 2 and the housing 1 is positioned and fixed, which will be described below in more detail.

The releasing component 2 can be generally constructed into a shape such as a long rod; however, in some application scenarios, it may also be constructed into other suitable shapes. Please refer to FIG. 2 and FIG. 3 together. In the provided embodiment, the releasing component 2 passes through the housing 1 through, for example, a through hole 7 disposed on an upper portion of the housing 1, and it is provided with a groove 21 and a groove 22 on its portion located in the housing 1. For example, the two grooves are disposed on upper and lower sides of the releasing component 2 and match the respective arc-shaped outlines of the positioning pin 3, 4, such that the releasing component 2 can accommodate the respective sections, having an arc-shaped outline, of the positioning pin 3 and the positioning pin 4 respectively through the grooves 21 and 22, for positioning and fixing the releasing component 2 relative to the housing 1. Moreover, when the speed governor detects that the motion device is overspeed and moves the releasing component 2 relative to the housing 1 (for example, manipulates the releasing component 2 by a speed governor rope, a linkage mechanism, and the like connected to a connecting portion 9 on the releasing component 2), the grooves 21 and 22 on the releasing component 2 will be separated from the sections of the positioning pin 3 and the positioning pin 4.

More specifically, when the motion device operates normally, no operation needs to be performed on the releasing component 2, and in this case, it is expected that a relative position between the releasing component 2 and the housing 1 can be maintained steadily and reliably. That is, in a normal state, a normal working position of the releasing component 2 should be kept steady and balanced, and the releasing component 2 is prevented from unexpected misoperations due to an inertia force generated by starting, stopping, accelerating, decelerating, and other movements of the motion device. In the foregoing embodiment of the present invention, the above expected technical effects can be achieved effectively by means of the matching contact between the grooves 21 and 22 on the releasing component 2 and the respective arc-shaped outlines of the positioning pins 3 and 4.

Once the motion device is overspeed, the overspeed condition will be detected by the speed governor in the speed governing system, and the speed governor will apply an acting force to the releasing component 2 by direct manipulation or by indirect manipulation through another component, device, or mechanism (for example, a linkage mechanism and the like can be combined for an elevator), such that the releasing component 2 will move relative to the housing 1 in, for example, a direction A shown in FIG. 2. Therefore, the grooves 21 and 22 are caused to make a rolling contact movement relative to the respective arc-shaped outlines of the positioning pins 3 and 4. In this case, as contact regions of the respective arc-shaped outlines change constantly, the pedestal 11 and the positioning pin 4 located thereon will be moved together downward to compress the elastic component 5 downward. Finally, the grooves 21 and 22 are respectively separated from the contact sections of the positioning pins 3 and 4, such that the releasing component 2 can leave the abovementioned normal working position quickly and timely in response to the manipulation of the speed governor, implementing the required safety protection function. As described above, in the foregoing embodiment of the present invention, the above expected technical effects can be achieved effectively by means of the matching contact between the grooves 21 and 22 on the releasing component 2 and the respective arc-shaped outlines of the positioning pins 3 and 4.

In the prior art, the releaser is generally provided by disposing a V-shaped groove on a releasing rod of the releaser and fitting a component that is disposed in the housing and has a sharp-angled part into the V-shaped groove directly. The above or similar various types of existing releasers have been applied quite widely in the industry. However, the inventor has found through researches that these existing releasers have some disadvantages and problems, especially the releaser using the above structure will be sensitive to the speed of the motion device, thus having a large risk of misoperation or non-operation. Moreover, a frictional coefficient of a contact surface between the component having the sharp-angled part and the V-shaped groove of the releasing rod is high (e.g., up to 0.3, 0.4, or higher) and very unstable, and large operation noise is easily generated, which is difficult to meet the use requirement of a product. Moreover, the inventor has also found that the housing of the existing releaser generally has a complex shape, and thus it generally needs to be made by casting. Further, to prevent abrasion, the sharp-angled part of the above component generally needs to be made by using a highly-rigid material. All the above aspects will increase the comprehensive costs of using the conventional releasers.

Although the conventional releasers have the foregoing listed disadvantages and defects, it should be noted that these disadvantages and defects have never been well solved before the present invention is proposed because those skilled in the art have been accustomed to structures, compositions, and the like of this type of releasers as standard modes in the industry. According to the creative design ideas proposed by the inventor, the problems in the prior art have been overcome successfully, especially by using the mutual matching contact of the respective arc-shaped outlines, the frictional coefficient between the releasing component and the positioning pin can be reduced and the stability is improved significantly, thus improving the stability and reliability of actions of the lifting mechanism. Moreover, operation noise can be reduced effectively at the same time, thus improving the user experience. It is apparent that the existing releaser cannot provide these prominent technical effects and obvious advantages illustrated above.

Contents such as substantial structural compositions, working principles, and technical advantages of the releaser according to the present invention have been illustrated in detail in the foregoing through the examples of the releaser shown with reference to FIG. 1 to FIG. 4. However, it should be noted that various possible flexible designs, variations, and adjustments are allowed in the present invention according to actual application situations without departing from the essence of the present invention.

For example, it is shown in FIG. 2 that one or more gaskets 12 can be arranged between the elastic component 5 and an inner wall of the hollow cavity 6 to adjust the amount of compression of the elastic component 5, such that a suitable elastic force that needs to be released by the elastic component 5 can be determined according to a specific requirement, thus meeting requirements in terms of responsibility, stability, environment noise, and the like when the releaser performs a mechanical movement. However, the gasket 12 is not necessary in the technical solution of the present invention, and the number, material, thickness, shape, and the like of the disposed gaskets 12 all can be selected and set flexibly according to the design ideas of the present invention.

For another example, it is discussed in the foregoing that two positioning pins 3 and 4 having arc-shaped outlines are disposed at the same time in the example of the releaser, and the respective sections having arc-shaped outlines of the two positioning pins are both disposed to be perpendicular to the disposing direction of the releasing component 2. However, it should be noted that in an actual application, only one such positioning pin can be disposed in the releaser, and any other type of positioning pins, e.g., a positioning pin with a section having a sharp-angled outline, can be combined with it according to actual requirements.

Moreover, in some optional embodiments, it is even possible that only one positioning pin designed according to the present invention is disposed in the releaser, and no other positioning pin is disposed. In this case, the releasing component 2 can be positioned in the aforementioned normal working position steadily and reliably by means of another part such as an elastic component and can leave the normal working position in response to the manipulation of the speed governor when required, thus achieving the expected safety protection function.

In addition, it should be further appreciated that the positioning pin is allowed to be disposed flexibly in the present invention without departing from the essence of the present invention, and it is unnecessary to dispose the section(s) having arc-shaped outline(s) of this positioning pin or these positioning pins to be completely perpendicular to the disposing direction of the releasing component 2. It can be further appreciated that by disposing a structure such as an elongated groove on the outer wall of the housing 1, some positioning pins such as the positioning pin 4 in the foregoing embodiment can also be constructed to have an extending section, and an end of the extending section passes through the outer wall of the housing 1 to be disposed in the structure such as the elongated groove. This will not affect the moving action of these positioning pins such as the foregoing positioning pin 4 in the housing 1.

Moreover, in some optional embodiments, an observing part 8 may be further disposed on the releasing component 2. For example, the observing part 8 is constructed into any suitable shape such as a hole or a boss, and a suitable color can be coated on these shapes for people to observe a moving position of the releasing component 2 relative to the housing 1 by using the observing part 8 from the exterior of the housing 1. Therefore, it can be intuitively judged from the external whether the releasing component 2 has performed an action, i.e., it is determined whether the releasing component 2 has left the original normal working position in response to the manipulation of the speed governor.

It can be appreciated that the elastic component 5, the pedestal 11 and the like are arranged in the hollow cavity 6 in the housing 1 in the foregoing embodiments. However, in some optional embodiments, the elastic component 5 and the pedestal 11 can be changed to be fitted outside the housing 1. Moreover, a structure such as the aforementioned elongated groove is disposed correspondingly on the outer wall of the housing 1 to provide and define a moving track of these positioning pins such as the positioning pin 4. Therefore, in the releaser according to the present invention, the housing 1 may not be actually provided with the hollow cavity 6.

Moreover, according to the technical solution of the present invention, the function of the releaser can be implemented merely by a clearance fit structure disposed between the releasing component and the housing as well as the positioning pin. Therefore, in some optional embodiments, the elastic component 5 can be omitted. When the elastic component 5 is provided, the specific position of the elastic component 5 in the releaser will be allowed to be adjusted flexibly according to an actual application. For example, such an elastic component can be fitted on the external of the housing, as described above.

In addition, in the foregoing embodiment of the releaser, one or more gaskets 12 are provided as an elastic force adjusting component of the elastic component 5, so as to selectively adjust the elastic force of the elastic component 5 to meet an actual application requirement, thus achieving a better technical effect. However, it should be appreciated that any possible suitable structure, component or mechanism is also allowed in the present invention to implement such an elastic force adjusting function. For example, in some optional embodiments, correspondingly matched connection threads are disposed on an end cap 13 of the housing 1 and on the hollow cavity 6, one end of the elastic component 5 abuts against the end cap 13 directly, and then the elastic force of the elastic component 5 can be changed by adjusting the thread connection between the end cap 13 and the hollow cavity 6, thus achieving the specific application requirement. In this case, no gasket 12 needs to be disposed. Definitely, it is also allowable if one or more gaskets 12 are combined.

According to another technical solution of the present invention, a speed governing system is further provided. The speed governing system includes a speed governor for detecting an overspeed condition of a motion device (such as an elevator), and a releaser provided according to the design of the present invention and connected to the speed governor, thus implementing obvious technical advantages of the solution in the present invention compared with the prior art as described above. In a specific embodiment, the speed governing system according to the present invention can further include a linkage mechanism through which the releaser is connected to the speed governor. For example, one end of the linkage mechanism can be connected to a connecting portion 9 of the releasing component 2 in the foregoing releaser, and such a connecting portion 9 can be constructed into a hole, a groove, or any other suitable structure. The speed governor and the linkage mechanism are not a focus of the present invention and a large amount of this type of mechanical devices have been provided in the prior art, so they will not be elaborated here.

Moreover, the present invention further provides an elevator speed governing system. The elevator speed governing system is provided with the releaser designed and provided according to the present invention, or the speed governing system designed and provided according to the present invention, such that the elevator speed governing system has the significant technical advantages of the present invention compared with the prior art as described above.

Finally, the present invention further provides an elevator. The elevator has the elevator speed governing system designed and provided according to the present invention. In an actual application scenario, the elevator speed governing system designed and provided according to the present invention can be disposed at a car side or a counterweight side of the elevator.

The speed governing system, the releaser, the elevator speed governing system and the elevator according to the present invention are illustrated above in detail through examples. These examples are merely used for illustrating the principles of the present invention and implementation manners thereof, rather than limiting the present invention. Those skilled in the art can make various variations and improvements without departing from the spirit and scope of the present invention. Therefore, all equivalent technical solutions should fall within the scope of the present invention and defined by claims of the present invention.

What is claimed is:

1. A speed governing system, comprising a speed governor for detecting an overspeed condition of a motion device, and a releaser connected to the speed governor, wherein the releaser comprises:

a housing;

a first positioning pin having a section that is disposed in the housing and at least partially constructed to have an arc-shaped outline;

a second positioning pin having a section that is disposed in the housing and at least partially constructed to have an arc-shaped outline; and a releasing component passing through the housing and provided with a first groove on a first exterior edge of the releasing component located in the housing, wherein the first groove is constructed to be adaptable to the arc-shaped outline of the first positioning pin, for accommodating the first positioning pin to fix the releasing component relative to the housing, and be separated from the first positioning pin when the speed governor detects the overspeed condition and moves the releasing component relative to the housing;

the releasing component provided with a second groove on a second exterior edge of the releasing component located in the housing, wherein the second groove is constructed to be adaptable to the arc-shaped outline of the second positioning pin, for accommodating the second positioning pin to fix the releasing component relative to the housing, and be separated from the second positioning pin when the speed governor detects the overspeed condition and moves the releasing component relative to the housing.

2. The speed governing system of claim 1, wherein at least one of the first positioning pin and the second positioning pin has an extending section passing through an outer wall of the housing.

3. The speed governing system of claim 2, wherein the outer wall of the housing is provided with a recess or a protrusion that is adapted to fix an end of the extending section thereon.

4. The speed governing system of claim 1, wherein the outer wall of the housing is partially constructed to be adapted to fix an end of the extending section thereon.

5. The speed governing system of claim 1, wherein a disposing direction of the section of at least one of the first positioning pin and the second positioning pin is perpendicular to that of the releasing component.

6. The speed governing system of claim 1, wherein the housing has a hollow cavity, the releaser further comprises an elastic component located in the hollow cavity, and the elastic component is configured to provide an elastic force to cause the section of the second positioning pin to be accommodated in the second groove to fix the releasing component relative to the housing, and be compressed when the releasing component is moved relative to the housing to cause the second groove to be separated from the section of the second positioning pin.

7. The speed governing system of claim 6, wherein the releaser further comprises a pedestal located in the hollow cavity, the pedestal is disposed between the releasing component and the elastic component and abuts against the elastic component, and the second positioning pin is disposed on the pedestal.

8. The speed governing system of claim 6, wherein the releaser further comprises an elastic force adjusting component configured to adjust the elastic force of the elastic component.

9. The speed governing system of claim 1, wherein the releasing component is provided with an observing place configured for observing a relative moving position between the releasing component and the housing from an exterior of the housing.

10. The speed governing system of claim 1, wherein the housing is manufactured by machining.

11. The speed governing system of claim 10, wherein the housing is provided with an end cap to be fixedly mounted to the body of the housing.

12. The speed governing system of claim 1, wherein the elastic component is a spiral spring, and/or at least one of the first positioning pin and the second positioning pin is a cylindrical pin.

13. The speed governing system of claim 1, wherein the speed governing system further comprises a linkage mechanism through which the releaser is connected to the speed governor.

14. An elevator speed governing system, wherein the elevator speed governing system is provided with the speed governing system of claim 1.

15. An elevator, wherein the elevator is provided with the elevator speed governing system of claim 14.

16. The elevator according to claim 15, wherein the elevator speed governing system is disposed at a car side or a counterweight side of the elevator.

* * * * *